US010024103B2

(12) United States Patent
Lyon et al.

(10) Patent No.: US 10,024,103 B2
(45) Date of Patent: Jul. 17, 2018

(54) DOWN-THE-HOLE DRILL HAMMER HAVING A ROLLER RAMP CLUTCH

(71) Applicant: Center Rock Inc., Berlin, PA (US)

(72) Inventors: Leland H. Lyon, Roanoke, VA (US); Abram Simeon Lance, Boones Mill, VA (US)

(73) Assignee: Center Rock Inc., Berlin, PA (US)

( * ) Notice: Subject to any disclaimer, the term of this patent is extended or adjusted under 35 U.S.C. 154(b) by 233 days.

(21) Appl. No.: 15/014,973

(22) Filed: Feb. 3, 2016

(65) Prior Publication Data

US 2016/0222732 A1 Aug. 4, 2016

Related U.S. Application Data

(60) Provisional application No. 62/111,929, filed on Feb. 4, 2015.

(51) Int. Cl.
*E21B 4/14* (2006.01)

(52) U.S. Cl.
CPC ..... *E21B 4/14* (2013.01)

(58) Field of Classification Search
CPC ..... E21B 4/14
See application file for complete search history.

(56) References Cited

U.S. PATENT DOCUMENTS

| | | | |
|---|---|---|---|
| 2,889,711 A | 8/1955 | Morris | |
| 3,166,131 A | 1/1965 | Worman | |
| 4,427,079 A | 1/1984 | Walter | |
| 5,139,093 A | 8/1992 | Lyon | |
| 5,322,136 A | 6/1994 | Bui | |
| 5,350,242 A | 9/1994 | Wenzel | |
| 5,711,205 A | 1/1998 | Wolfer | |
| 6,035,953 A | 3/2000 | Rear | |
| 6,609,577 B2 | 8/2003 | Beccu | |
| 7,377,337 B2 | 5/2008 | Swietlik | |
| 7,703,550 B2 | 4/2010 | Nevlud | |
| 7,832,502 B2 | 11/2010 | Bui | |
| 7,975,784 B2 | 7/2011 | Purcell | |
| 7,987,930 B2 | 8/2011 | Purcell | |
| 8,347,988 B2 | 1/2013 | Gilbert | |
| 8,397,839 B2 | 3/2013 | Lyon | |
| 8,800,690 B2 | 8/2014 | Lyon | |
| 2009/0200082 A1* | 8/2009 | Bui | E21B 4/006 175/61 |
| 2009/0321143 A1* | 12/2009 | Lyon | E21B 4/14 175/293 |

FOREIGN PATENT DOCUMENTS

| | | |
|---|---|---|
| CA | 2256069 A1 | 6/2000 |
| EP | 0149290 A2 | 7/1985 |

* cited by examiner

*Primary Examiner* — Brad Harcourt
(74) *Attorney, Agent, or Firm* — Kim Winston LLP

(57) ABSTRACT

A down-the-hole drill hammer is provided that includes a housing, a drill bit, a piston, a roller ramp clutch and a coupler. The DHD is configured to have a bit-piston-clutch-casing torque circuit which concurrently rotates the piston and drill bit. The drill bit is positioned proximate a distal end of the housing. The piston is configured to reciprocally move within the housing along an axial direction. The piston includes a helical spline and an axial spline on a surface of the piston. The roller ramp clutch circumscribes and engages the piston. The coupler circumscribes and engages the piston and drill bit.

20 Claims, 13 Drawing Sheets

DOWN-THE-HOLE DRILL HAMMER HAVING A ROLLER RAMP CLUTCH

CROSS-REFERENCE TO RELATED APPLICATIONS

This application claims the benefit of U.S. Provisional Application No. 62/111,929, filed Feb. 4, 2015, the entire disclosure of which is incorporated by reference herein in its entirety.

BACKGROUND OF THE INVENTION

The present invention relates generally to down-the-hole drill (DHD) hammers. In particular, the present invention relates to a DHD hammer having a roller ramp clutch and coupler to simultaneously rotate a piston and drill bit.

Typical DHD hammers involve a combination of percussive and rotational movement of the drill bit to drill or chip away at rock. Such DHD hammers are powered by a rotatable drill string attached to a drilling platform that supplies rotation and high pressure gases (e.g., air) for percussive drilling. Moreover, in percussive drilling, rock cutting is a result of percussive impact forces rather than shear forces. In other words, rotation of the DHD hammer serves to rotationally index the drill bit to fresh rock formations after the drill bit impacts a rock surface rather than to impart shear cutting forces to the rock surface.

BRIEF SUMMARY OF THE INVENTION

In accordance with a preferred embodiment, the present invention provides a down-the-hole drill hammer that includes a housing, a drill bit, a piston, a roller ramp clutch and a coupler. The drill bit is positioned proximate a distal end of the housing. The piston is configured to reciprocally move within the housing along an axial direction. The piston includes a helical spline and an axial spline on a surface of the piston. The roller ramp clutch circumscribes and engages the piston. The coupler circumscribes and engages the piston and drill bit.

In accordance with an aspect of the present invention there is provided a down-the-hole drill hammer that includes a housing, a drill bit, a piston and a clutch assembly. The drill bit is positioned at a distal end of the housing. The piston is configured to reciprocally move within the housing along an axial direction. The clutch assembly includes a roller ramp clutch and a coupler, and circumscribes the piston and drill bit.

In accordance with another aspect of the present invention, the problems associated with conventional drill bit rotation is solved be engendering a down-the-hole drill hammer in which the drill bit and piston and rigidly coupled together to rotate concurrently.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
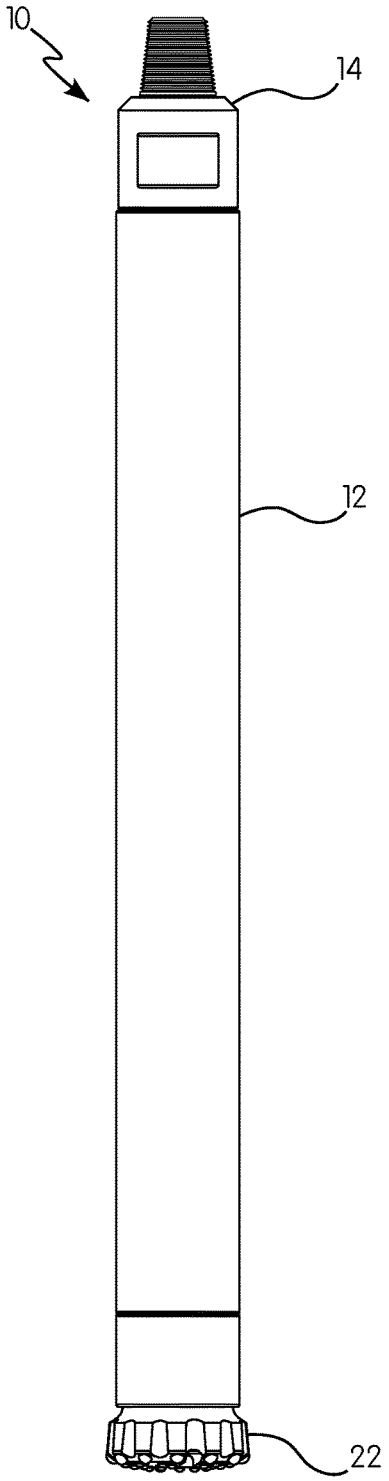
FIG. 1 is a side elevation view of a down-the-hole drill hammer in accordance with a preferred embodiment of the present invention.

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The term "proximal" refers to being nearer to the center of a body or a point of attachment of a drill string to the DHD hammer. The term "distal" refers to being away from the center of a body or from the point of attachment of the drill string to the DHD hammer. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Ranges throughout this disclosure and various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

In accordance with a preferred embodiment, the present invention provides a down-the-hole drill hammer 10, as shown in FIGS. 1 through 14B. The DHD hammer 10 includes a housing or casing 12, a backhead 14, a piston 16, a roller ramp clutch 18, a coupler 20 and a drill bit 22. The roller ramp clutch and coupler collectively form a clutch assembly 19. The clutch assembly circumscribes the piston and drill bit.

The housing 12 has a generally cylindrical configuration to allow for the housing to at least partially or completely house the backhead 14 and drill bit 16. The housing 12 also houses the piston 16 and the clutch assembly 19, as further described below.

The backhead 14 can be any conventional backhead readily used in DHD hammers. The structure and operation of such backheads are readily known in the art and a detailed description of them is not necessary for a complete understanding of the present invention. However, exemplary backheads suitable for use in the present embodiment are described e.g., in U.S. Pat. Nos. 5,711,205 and 8,397,839, the entire disclosures of which are hereby incorporated by reference for all purposes.

Figure 2:
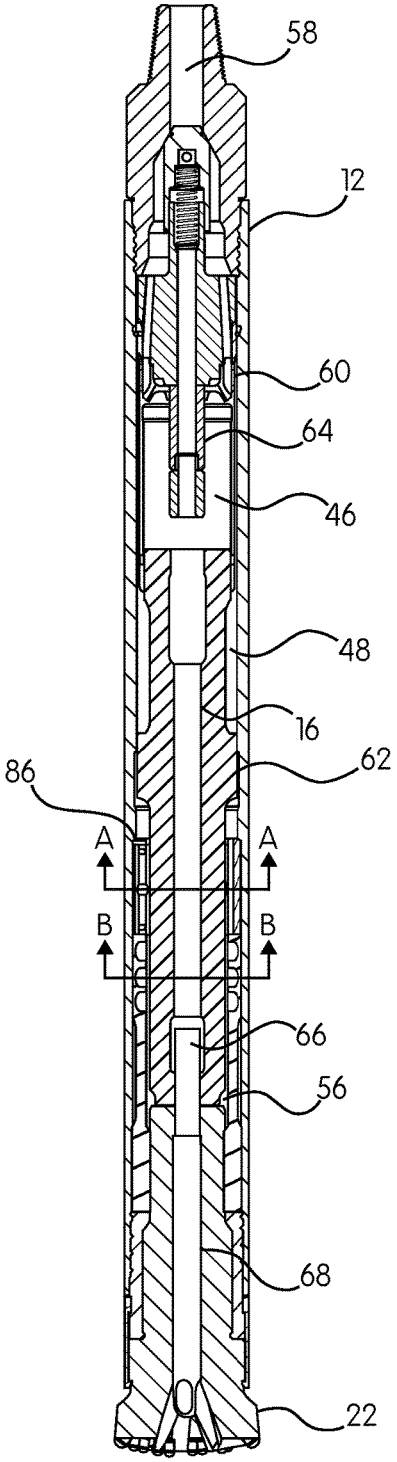
FIG. 2 is a cross-sectional side elevation view of the down-the-hole drill hammer of FIG. 1.
Figure 3:
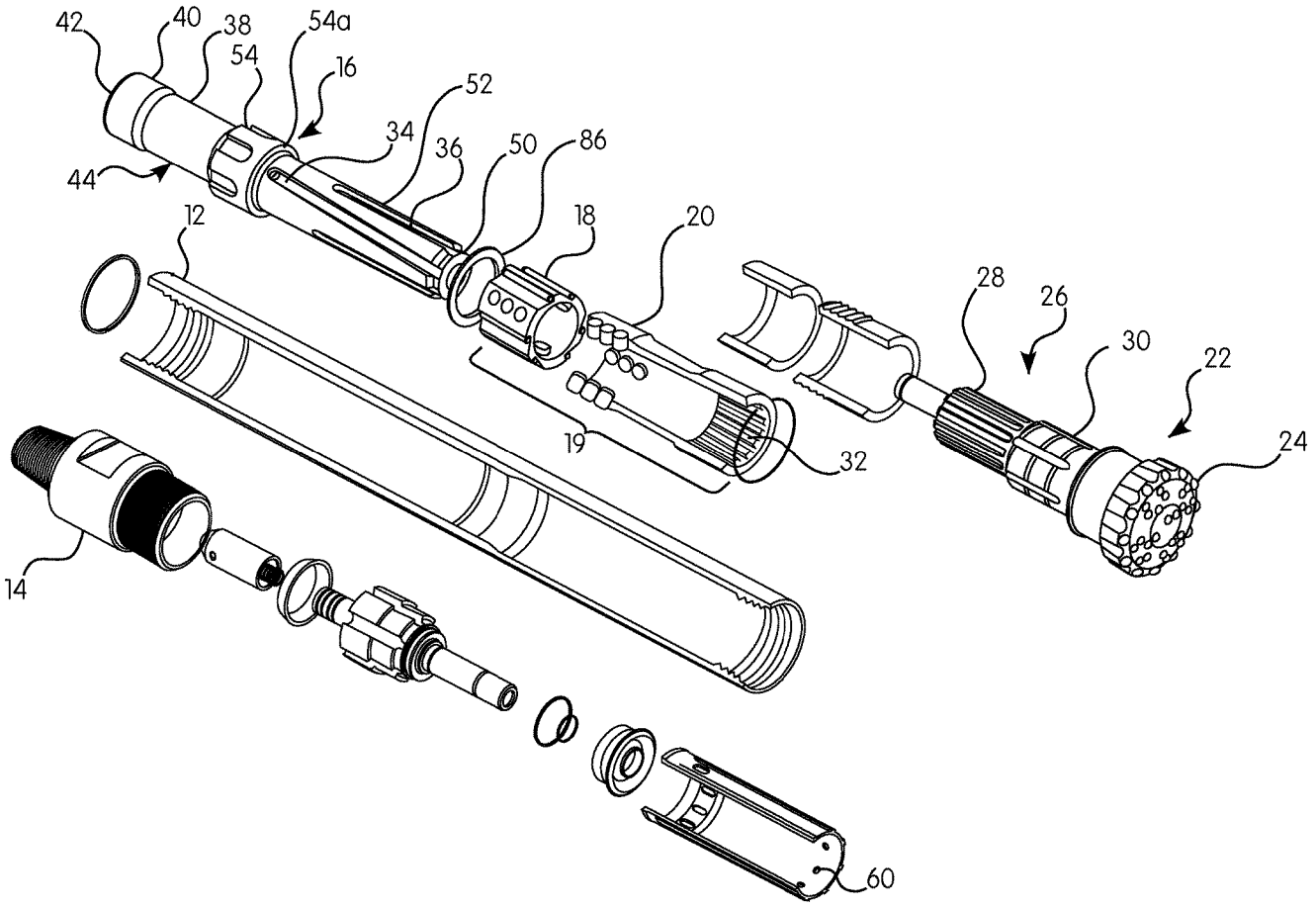
FIG. 3 is an exploded perspective view of the down-the-hole drill hammer of FIG. 1 with certain components including a coupler and casing shown in partial view for purposes of illustration.
Figure 4:
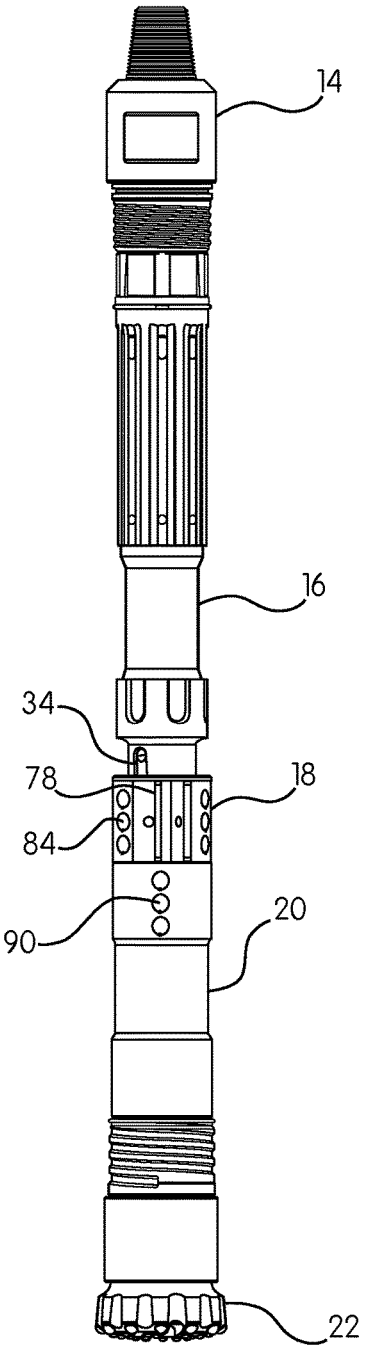
FIG. 4 is a side elevation view of the down-the-hole drill hammer of FIG. 1 without a housing.
Figure 7:
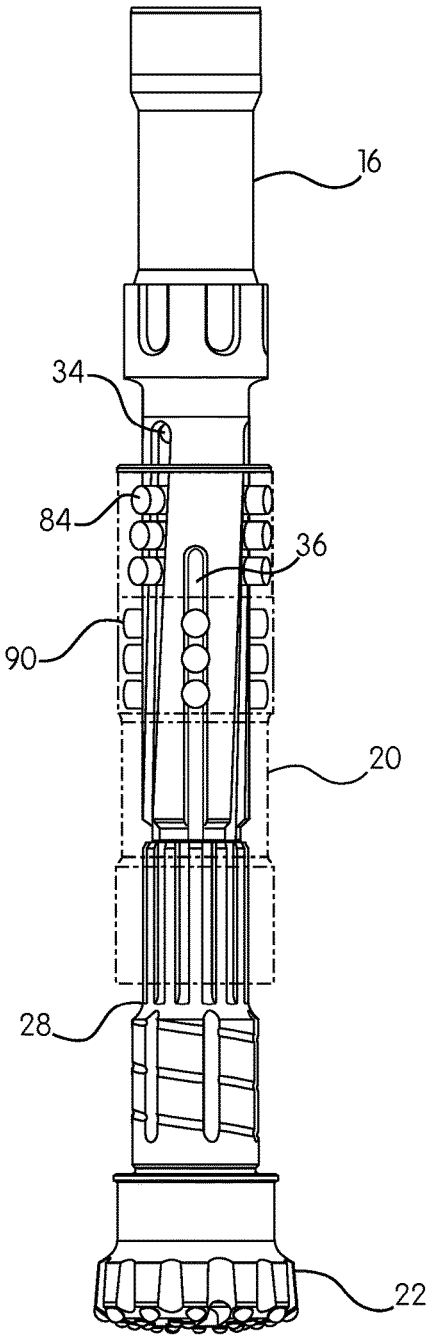
FIG. 7 is a side elevation view of a bottom portion of the down-the-hole drill hammer of FIG. 4 but with parts of a roller ramp clutch and coupler drawn in phantom.
Figure 5:
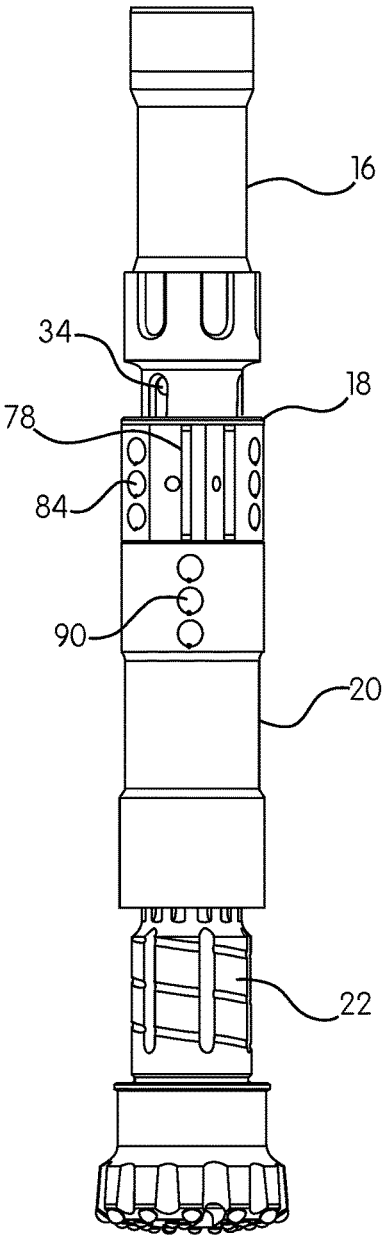
FIG. 5 is a side elevation view of a bottom portion of the down-the-hole drill hammer of FIG. 4.
Figure 6:
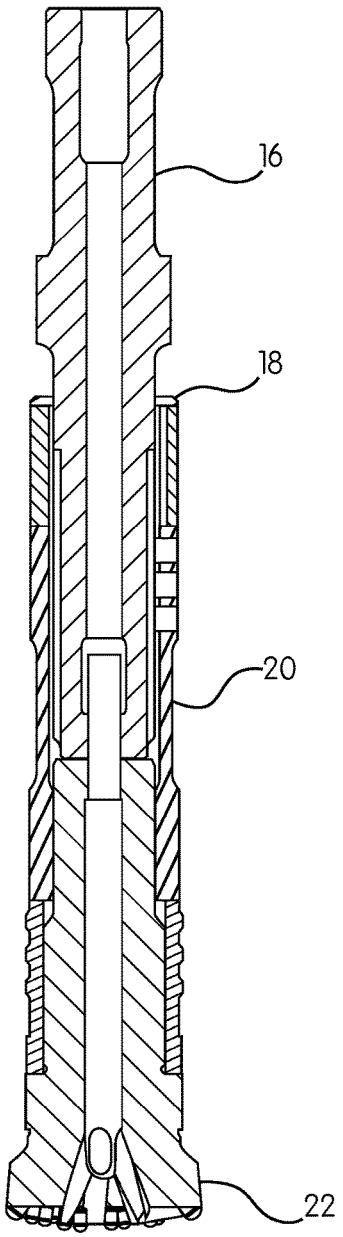
FIG. 6 is a cross-sectional side elevation view of a bottom portion of the down-the-hole drill hammer of FIG. 4.
Figure 8:
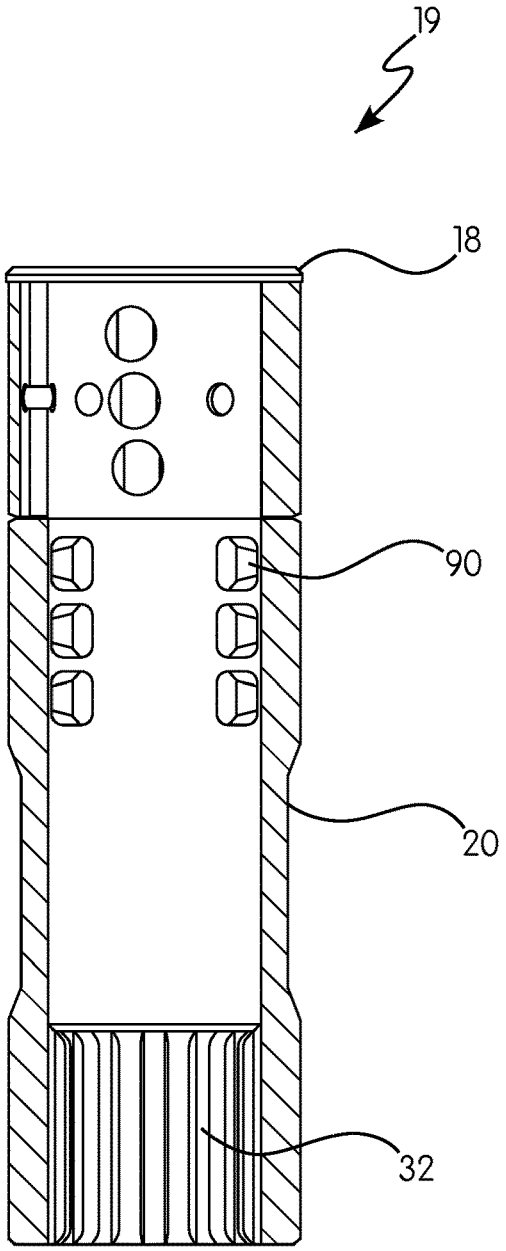
FIG. 8 is a cross-sectional side elevation view of a clutch assembly and coupler of the down-the-hole drill hammer of FIG. 1.
Figure 9:
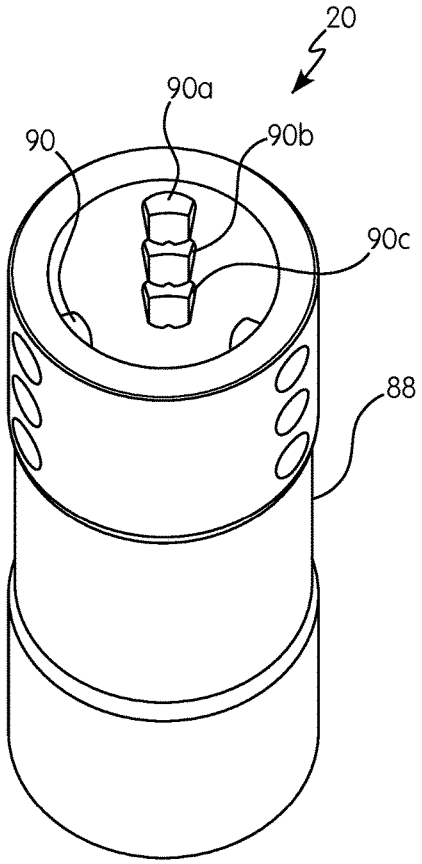
FIG. 9 is a top perspective view of a coupler of the down-the-hole drill hammer of FIG. 1.
Figure 10:
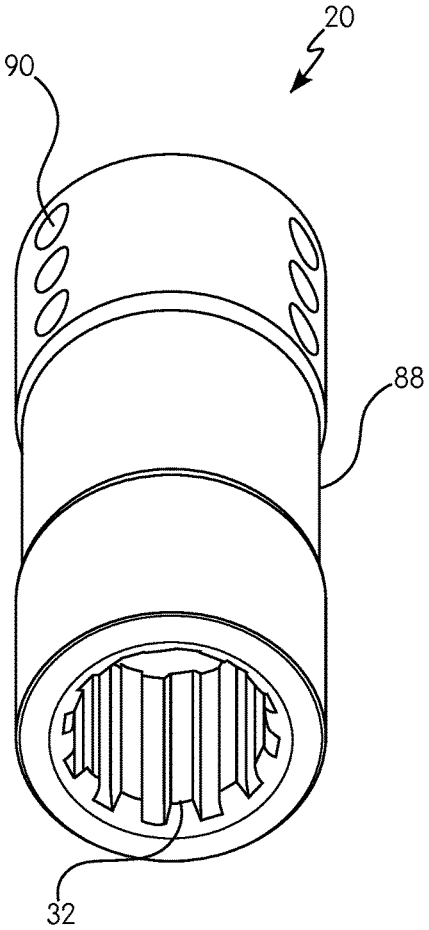
FIG. 10 is a bottom perspective view of the coupler of FIG. 9.
Figure 11:
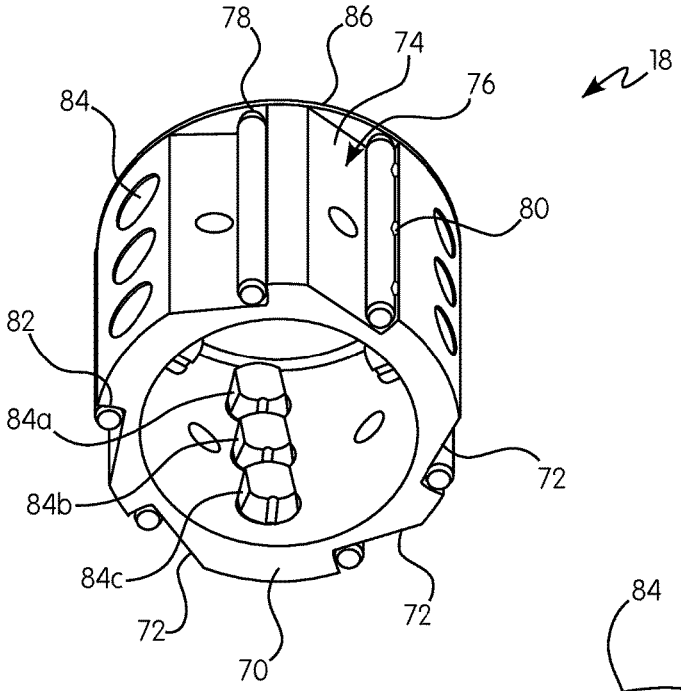
FIG. 11 is a bottom perspective view of a roller ramp clutch of the down-the-hole drill hammer of FIG. 1.
Figure 12:
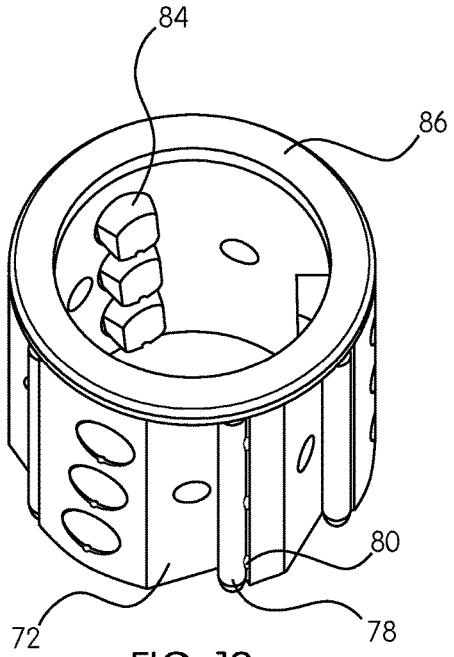
FIG. 12 is a top perspective view of the roller ramp clutch of FIG. 11.
Figure 13:
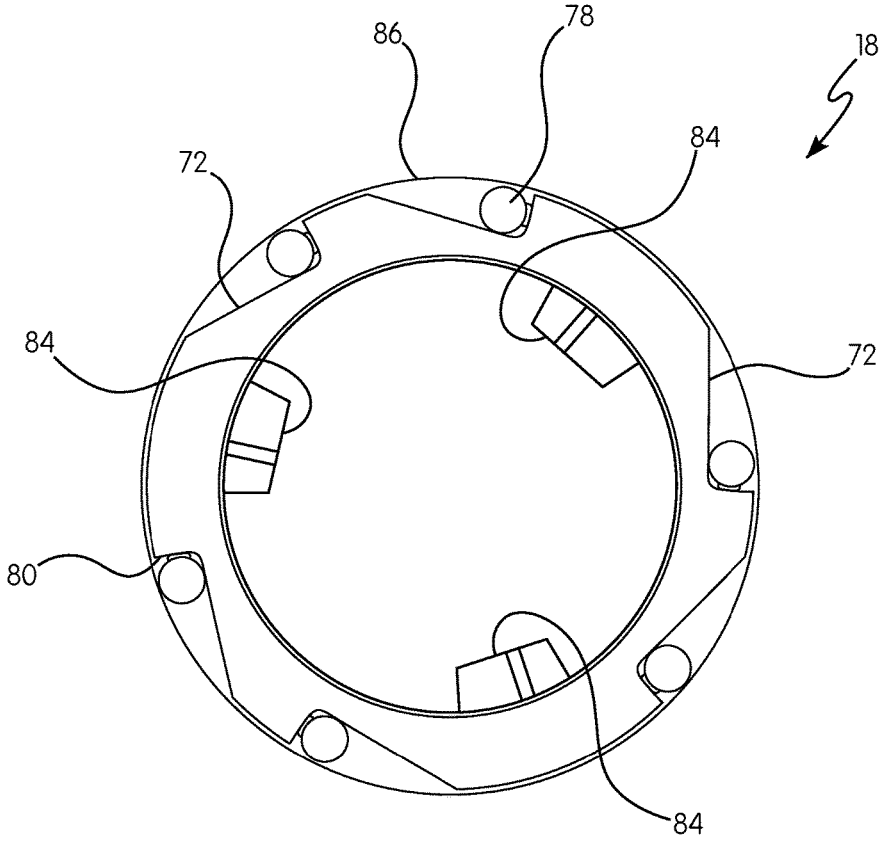
FIG. 13 is bottom plan view of the roller ramp clutch of FIG. 11.

FIGS. 2 and 3 best illustrate the drill bit 22. The drill bit 22 is proximate a distal end of the housing. In other words, the drill bit is connected to the DHD hammer at a distal end of the housing. The drill bit 22 is a single piece constructed part and is configured with a head 24 and a shank 26. The head 24 is generally configured similarly to conventional heads used in DHD hammers and includes a plurality of inserts (also known as cutting inserts). As a rule of thumb, drill bits are typically operated with a rotational index angle of about 70-100% of the insert diameter per impact.

The shank 26 of the drill bit 22 is configured with a plurality of circumferentially spaced splines 28 at its proximal end having an overall diameter that is slightly smaller than a body 30 of the shank, as best shown in FIG. 2. The splines 28 are configured to engage complimentary splines 32 on the coupler, as further described below.

The piston 16 is configured as best shown in FIGS. 2 and 3. The piston is configured to reciprocally move within the housing along an axial direction. The piston includes a helical spline 34 and an axial spline 36 about its lower half or distal portion. Preferably, the piston includes three helical splines and three axial splines evenly and circumferentially spaced apart in an alternating fashion about a surface of the piston. However, other arrangements in number and size, and spacing of the axial splines and/or the helical splines may be used. Each helical spline 34 is circumferentially spaced from an adjacent axial spline.

The helical and straight axial splines 34, 36 are preferably configured as female splines. The axial splines 36 run generally parallel with a central longitudinal axis of the piston 16. The helical splines 34 are configured to run in a generally helical fashion, such that upon movement of the piston 16 in the distal direction, the helical splines 34 function to rotate and lock the roller ramp clutch, as further described in detail below.

The piston's proximal end includes a smaller diameter section 38, a larger diameter section 40 and a drive surface 42. The areas generally encompassing the smaller diameter section 38, the larger diameter section 40, and the drive surface 42 comprise a piston drive area 44. The drive surface 42 in combination with the inner wall of the housing 12 generally comprise a driver chamber 46 while the larger diameter section 40 and the smaller diameter section 38 in combination with the inner wall of the housing 12 generally comprise a reservoir 48.

The area generally encompassing the distal end face 50, an outer surface 52 and a distal edge 54*a* of a larger diameter section 54 of the piston 16 comprise a piston return area or return chamber 56. By alternating between high (supply) and low (exhaust) pressures within the piston drive chamber 46 and piston return area 56, the piston 16 is cycled axially e.g., about four (4) inches per cycle at about 1,600 cycles/minute to induce percussive forces on the drill bit 22. The alternating high and low pressure is cycled through the DHD hammer 10 through conventional porting within the DHD hammer as best shown in FIG. 2. Such porting of DHD hammers are known in the art and a detailed description of them is not necessary for a complete understanding of the present embodiment.

However, as shown in FIG. 2, such porting systems can include a central port 58, blow ports 60, a lower piston seal path 62, an exhaust valve stem 64, an exhaust tube 66 and a central bit flushing port 68. The porting system as shown provides a fluid passageway which allows for supply flow to compress and exhaust working air pressures within the drive chamber 46, reservoir 48 and return chamber 56 to reciprocally drive the piston 16 within the housing 12.

The roller ramp clutch 18 is configured, as best shown in FIGS. 3 and 11-14A, and circumscribes and engages the piston 16. The roller ramp clutch 18 includes an annular hub 70 having a plurality of ramps 72 along its outer surface. The annular hub 70 is sized to receive the distal portion of the piston 16 therethrough.

Each ramp 72 extends along the entire axial length of the annular hub and is formed by a planar surface 74 extending inwardly from an outer circumference of the annular hub forming a tapered recess 76. Preferably, the annular hub includes six ramps circumferentially spaced apart. However, the annular hub can alternatively be configured to include more or less than six ramps, such as 1, 2, 3, 4, 5, 7, 8, 9, 10 or more ramps.

The roller ramp clutch also includes a dowel 78 sized to fit within a most widened end of each respective recess 76. That is, each dowel 78 is sandwiched between an interior of the housing wall and the recess 76 of the annular hub.

Optionally, the roller ramp clutch can include one or more biasing members 80 positioned between a lateral wall 82 of the ramp 72 and the dowel 78.

Figure 14A:
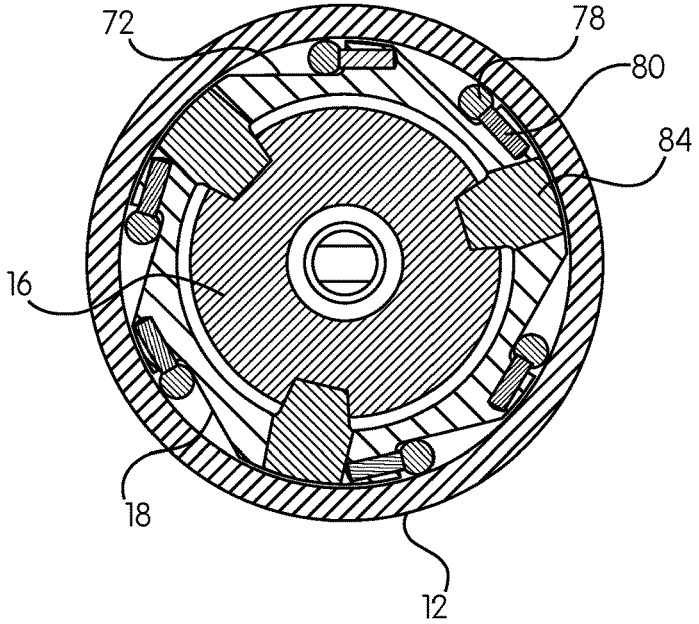
FIG. 14A is a longitudinal cross-sectional view of a roller ramp clutch of the down-the-hole drill hammer of FIG. 2.

The roller ramp clutch 18 further includes a bearing 84 engaging the helical spline 34 of the piston. Preferably, the roller ramp clutch includes a plurality of bearings 84*a*, 84*b*, 84*c* helically arranged engaging the helical spline 34 of the piston. More preferably, the roller ramp clutch includes three sets of three bearings helically arranged engaging a respective helical spline on the piston. FIG. 14A illustrates in cross-sectional view the roller ramp clutch assembled within the housing.

The dowels 78 are maintained within their respective recesses by an annular ring 86 situated about a top side of the hub 70 and the presence of the coupler 20 adjacent the bottom side of the hub. The dowels can be formed from hardened steel or any other material suitable for its intended purpose.

When arranged within the housing 12, the roller ramp clutch 18 is positioned adjacent an inwardly extending flange portion 86 of the housing.

Figure 14B:
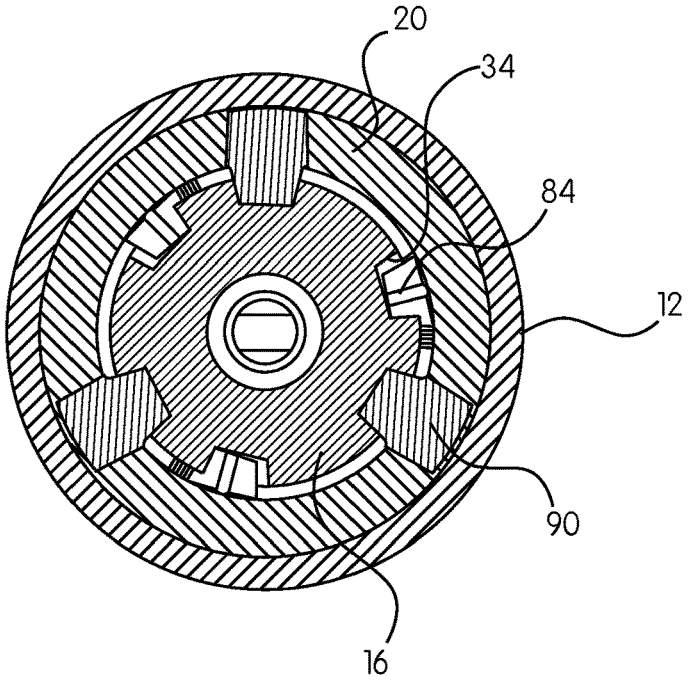
FIG. 14B is a longitudinal cross-sectional view of a coupler of the down-the-hole drill hammer of FIG. 2.

The coupler 20 is configured, as best shown in FIGS. 2, 3, 8-10 and 14B, and circumscribes and engages the piston 16 and drill bit 22 (see FIGS. 2 and 14B). The coupler is generally configured with a cylindrical body 88 having a proximal end sized to receive the distal portion of the piston 16 for reciprocal movement therein, and a distal end sized to receive and engage a proximal end of the drill bit 22.

The coupler includes a bearing 90 about its proximal end engaging the axial spline 36 of the piston. Preferably, the coupler includes three bearings circumferentially spaced for engaging respective splines on the piston when arranged with three axial splines. More preferably, the coupler includes a series of three bearings 90*a*, 90*b*, 90*c* arranged in a linear fashion for engaging the axial spline 36. The number of series of three bearings can be arranged to correspond to the number of axial splines configured on the piston, e.g., three sets of series of three bearings when the piston is arranged with three axial splines.

About its distal end, the coupler includes the plurality of splines 32 which are configured to matingly engage the plurality of splines 28 on the drill bit 22. Accordingly, as the piston rotates, it rotates the coupler owing to the engagement of the piston to the couple via bearings 90. In other words, the coupler rotates coincidentally with the piston once the roller ramp clutch locks in position, as further discussed below.

As best shown in FIG. 2, when fully assembled, the roller ramp clutch 18 and coupler 20 are fixed in position within the housing 12, with only the piston and drill bit being movable relative to the clutch assembly 19. The roller ramp clutch is positioned adjacent the coupler and within the housing for engaging a lower half or distal portion of the piston. The coupler 20 is sized and configured such that it simultaneously engages both the piston and drill bit, thus advantageously allowing simultaneous rotational movement of the piston and drill bit which allows for improved consistency of operation. In other words, the piston and drill bit are coupled together by the coupler for rotating concurrently. That is, as a result of the rigid design of the coupler and its engagement with each of the piston and drill bit, the piston and drill bit exhibits matched rotational translation.

The foregoing arrangement of the DHD hammer 10 provides a torque path or torque circuit of drill bit, piston, clutch and housing (or casing). This resultant torque circuit provides for reduced backlash and lost motion compared to conventional DHD hammer torque circuits.

Operation of the roller ramp clutch is best illustrated with reference to FIGS. 2, 3, 13 and 14A. The operation of the DHD hammer piston cycle and roller ramp clutch will begin with the piston at its impact point on the drill bit. In this exemplary description, the casing is rotationally stationary and the roller ramp clutch is configured to engage the piston on its downward or impact stroke.

FIG. 2 illustrates the piston at its impact point on the drill bit. FIGS. 3 and 14A illustrate the roller ramp clutch 18 is in its initial position ready for rotation in the clockwise direction when viewed as shown in FIG. 14A.

At this point in the piston cycle, drive chamber pressure has exhausted and return chamber is pressurized causing the piston 16 to move upward. Due to the helical spline direction and orientation of the roller ramp clutch, the clutch is free to rotate relative to the casing. That is, the direction of rotation forces the wedge spacing, formed by the ramps 72 and inner wall surfaces of the casing, to increase allowing the rollers (or dowels) 78 to slide. The piston then moves axially without any torque applied from the roller ramp clutch. In an exemplary example, the piston can be configured to have a stroke length of about 5 inches and a helical pitch of about 180 inches per revolution. Thus, the roller ramp clutch free-wheels approximately 10 degrees from its initial position to the point where its upward motion stops.

Due to the valve and porting arrangement in the DHD hammer, the upward force on the piston eventually reverses into a downward force causing the piston direction to reverse. As this happens, the direction of rotation of the roller ramp clutch reverses and the wedge space decreases causing the rollers pins (or dowels) to lock and freeze the roller ramp clutch relative to the casing. As the piston begins its downward stroke, torque is applied by the roller ramp clutch to the helical piston races 34 thus causing the piston 16, coupler 20 and drill bit 22 to rotate. Assuming no lost motion within the transmission, the drill bit will index e.g., 10 degrees. It is important to note that once the drill bit is turning, the roller ramp clutch can only lock on the casing when its rotational direction relative to the casing causes the dowels to lock. That is, the piston is rotating the roller ramp clutch in one direction and the helical races 34 on the piston rotates the roller ramp clutch in the other and the net roller ramp clutch speed has to be reversed for the clutch to lock and impart torque on the piston.

In other words, when the piston starts its downward stroke, due to the helical curvature of the piston's helical spline 34, it engages the bearings 84 on the roller ramp clutch 18 to rotate it. This rotation of the roller ramp clutch is relative to the coupler. That is, the roller ramp clutch rotates relative to the coupler during this phase. The roller ramp clutch locks and stops rotating when the dowels 78 become wedged in between the housing wall and respective ramp 72. The angle of the ramps are configured such that the dowels 78 become wedged or locked about the piston's downward stroke. Upon reaching its rotational stop, the roller ramp clutch remains fixed in position thereby causing the piston to rotate in an opposite direction of the rotation of the roller ramp clutch. The piston continues to rotate until it completes its downward stroke.

In sum, the roller ramp clutch is configured to lock when rotated in the locking direction e.g., in the clockwise direction when viewed as shown in FIG. 14A. The roller ramp clutch can lock anywhere along the piston's stroke length e.g., near its beginning stroke length, at its mid-stroke length position, or at the end of its stroke length. Factors that affect the position at which the roller ramp clutch locks in position include the speed of travel of the piston and the rotational speed of the coupler and/or drill bit.

Due to the coupled connection between the piston and drill bit via the coupler 20, the drill bit rotates coincidentally with the rotation of the piston upon the roller ramp clutch locking in position. This advantageously provides greater rotational inertia thereby providing improved consistency and reliability during performance.

FIGS. 15-18 illustrate another preferred embodiment of a down-the-hole drill hammer in accordance with the present invention. The down-the-hole drill hammer 110 is similarly configured to the down-the-hole drill hammer 10 described above, except for the configuration of a roller ramp clutch 118 and coupler 120. As such, only the roller ramp clutch 118 and coupler 120 will be described in further detail.

Figure 15:
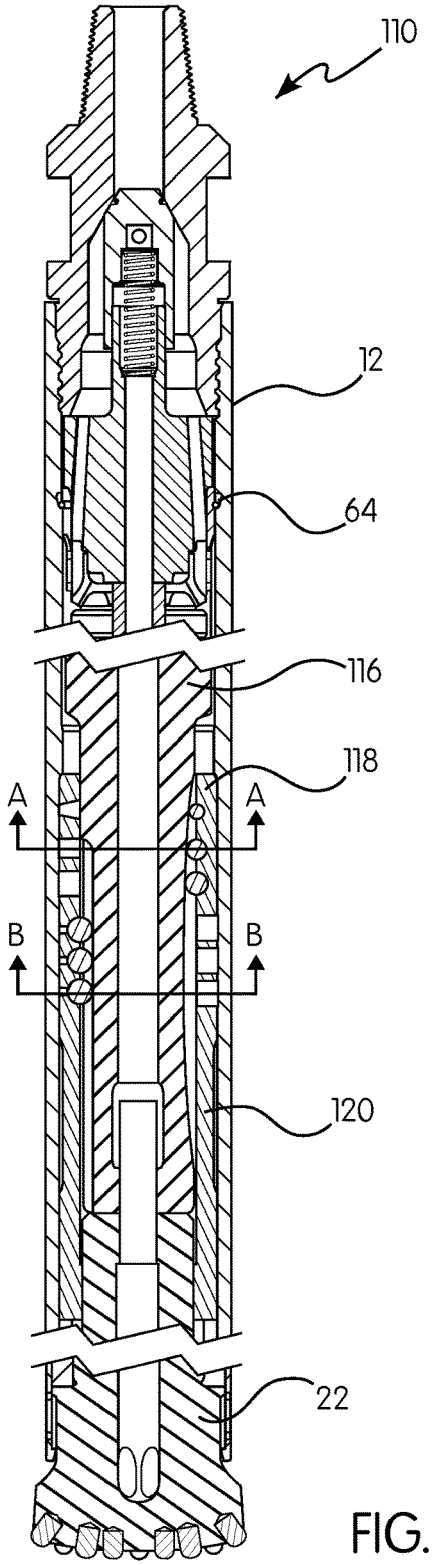
FIG. 15 is a partial cross-sectional side elevation view of a down-the-hole drill hammer in accordance with another preferred embodiment of the present invention.
Figure 16A:
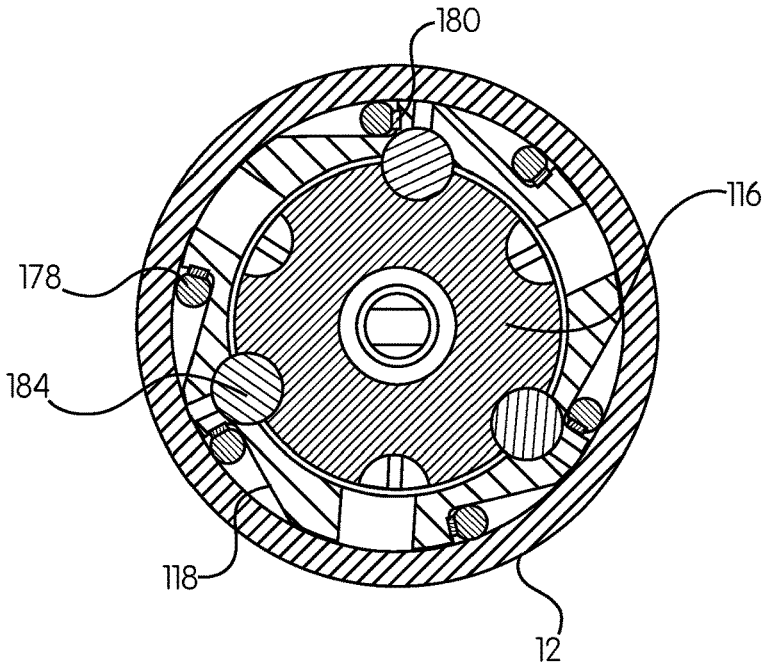
FIG. 16A is a longitudinal cross-sectional view of a roller ramp clutch of the down-the-hole drill hammer of FIG. 15.
Figure 17:
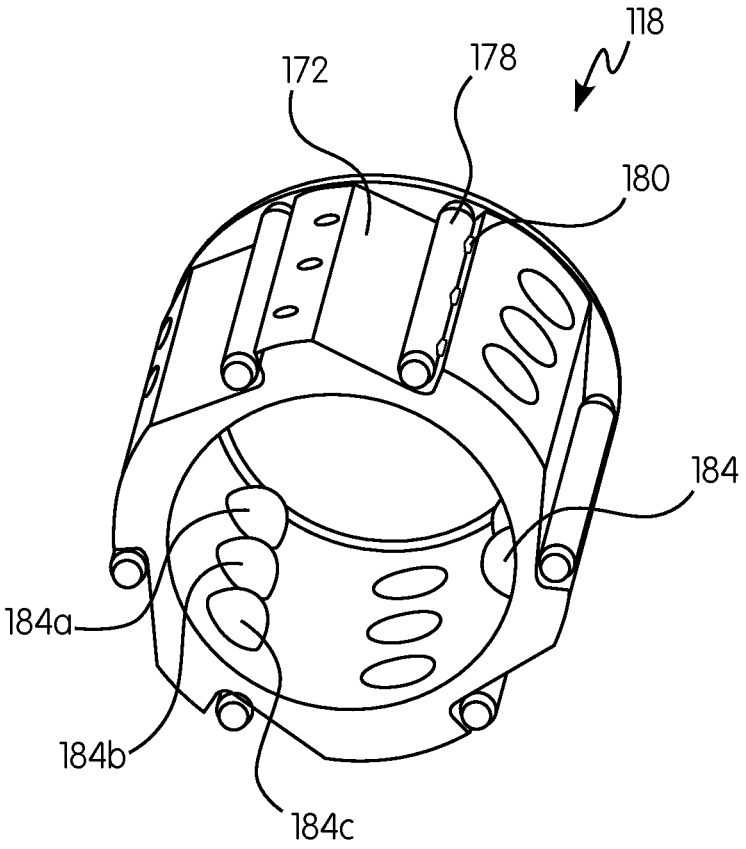
FIG. 17 is a perspective view of a roller ramp clutch of the down-the-hole drill hammer of FIG. 15.

The roller ramp clutch 118 is best shown in FIGS. 15, 16A and 17. The roller ramp clutch 118 is configured similar to roller ramp clutch 18, but configured with spherical bearings 184, e.g., spherical bearings 184*a*, 184*b*, 184*c*. Each spherical bearing is received within a corresponding recess within the annular hub of the roller ramp clutch. Additionally, similar to roller ramp clutch 18, roller ramp clutch 118 includes dowels 178, ramps 172 and biasing members 180. All other aspects of the roller ramp clutch 118 are the same as for roller ramp clutch 18.

Figure 16B:
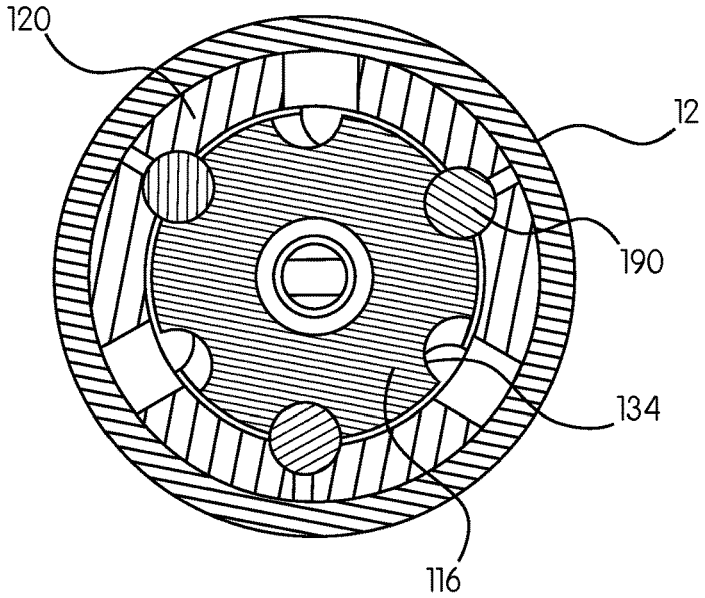
FIG. 16B is a longitudinal cross-sectional view of a coupler of the down-the-hole drill hammer of FIG. 15.
Figure 18:
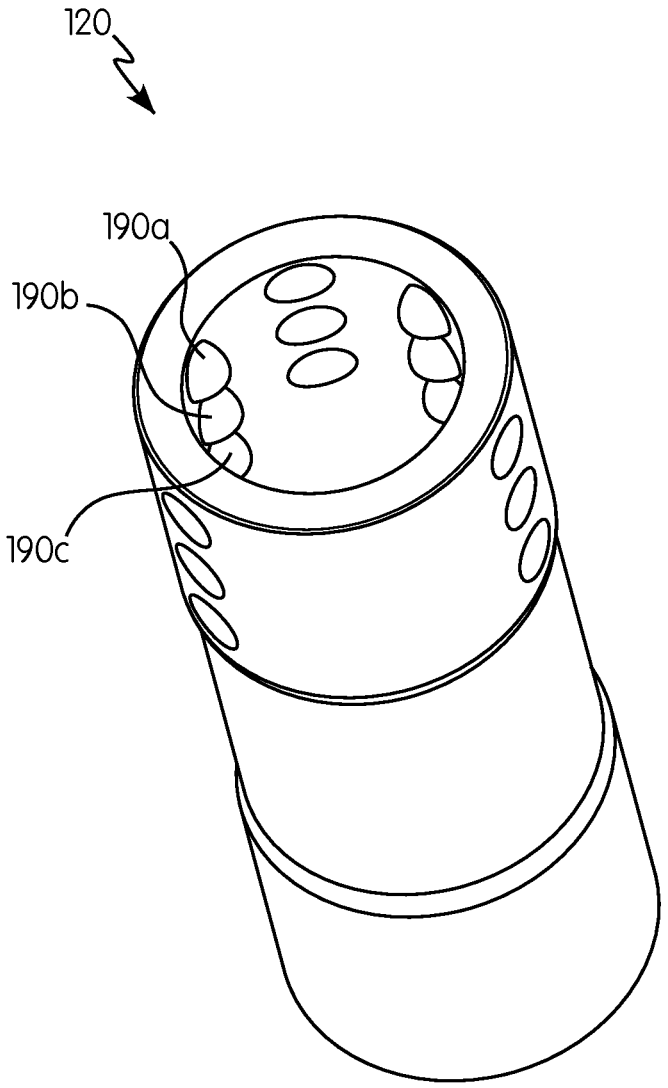
FIG. 18 is a perspective view of a coupler of the down-the-hole drill hammer of FIG. 15.

The coupler 120 is best shown in FIGS. 15, 16B and 18. The coupler 120 is configured similar to coupler 20, but configured with spherical bearings, e.g., spherical bearings 190*a*, 190*b*, 190*c*. All other aspects of the coupler are the same as for coupler 20.

It will be appreciated rotational by those skilled in the art that changes could be made to the preferred embodiments described above without departing from the broad inventive concept thereof. It is to be understood, therefore, that this invention is not limited to the particular embodiments disclosed, but it is intended to cover modifications within the spirit and scope of the present invention as defined by the claims.

We claim:

1. A down-the-hole drill hammer comprising:

a housing;

a drill bit proximate a distal end of the housing; a piston configured to reciprocally move within the housing along an axial direction, the piston including a helical spline and an axial spline on a surface of the piston;

a roller ramp clutch circumscribing and engaging the piston; and a coupler circumscribing and engaging the piston and drill bit.

2. The down-the-hole drill hammer of claim 1, wherein the roller ramp clutch includes a bearing engaging the helical spline of the piston.

3. The down-the-hole drill hammer of claim 1, wherein the piston includes three helical splines and the roller ramp clutch includes three sets of bearings each helically arranged engaging a respective helical spline of the piston.

4. The down-the-hole drill hammer of claim 1, wherein the coupler includes a bearing engaging the axial spline of the piston.

5. The down-the-hole drill hammer of claim 1, wherein the piston includes three axial splines and the coupler includes three bearing each engaging a respective axial spline of the piston.

6. The down-the-hole drill hammer of claim 1, wherein the coupler includes a plurality of splines for engaging a plurality of splines on the drill bit.

7. The down-the-hole drill hammer of claim 1, wherein the coupler includes a bearing about a proximal end engaging the axial spline of the piston, and a plurality of splines about a distal end for engaging a plurality of splines on the drill bit.

8. The down-the-hole drill hammer of claim 1, wherein the helical spline is circumferentially spaced from the axial spline, and the roller ramp clutch is configured to lock when rotated in a locking direction.

9. The down-the-hole drill hammer of claim 1, wherein the helical spline is configured to lock the roller ramp clutch about a downward stroke.

10. The down-the-hole drill hammer of claim 1, wherein the piston and drill bit are coupled together by the coupler for rotating concurrently.

11. The down-the-hole drill hammer of claim 1, wherein the roller ramp clutch is positioned adjacent the coupler.

12. The down-the-hole drill hammer of claim 1, wherein the roller ramp clutch is positioned within the housing for engaging a lower half of the piston.

13. The down-the-hole drill hammer of claim 1, wherein the roller ramp clutch engages a distal portion of the piston.

14. A down-the-hole drill hammer comprising:

a housing;

a drill bit at a distal end of the housing; a piston configured to reciprocally move within the housing along an axial direction; and a clutch assembly circumscribing the piston and drill bit, the clutch assembly including:

a roller ramp clutch, and a coupler.

15. The down-the-hole drill hammer of claim 14, wherein the roller ramp clutch engages a helical spline on the piston.

16. The down-the-hole drill hammer of claim 14, wherein the roller ramp clutch includes a bearing for engaging a helical spline on the piston.

17. The down-the-hole drill hammer of claim 14, wherein the coupler engages an axial spline on the piston.

18. The down-the-hole drill hammer of claim 14, wherein the coupler engages the piston and drill bit for simultaneous rotation of the piston and drill bit.

19. The down-the-hole drill hammer of claim 14, wherein the roller ramp clutch rotates relative to the coupler.

20. The down-the-hole drill hammer of claim 14, wherein the coupler engages a distal end of the piston and a proximal end of the drill bit.

* * * * *